US011731431B2

(12) United States Patent
Yamagata et al.

(10) Patent No.: US 11,731,431 B2
(45) Date of Patent: Aug. 22, 2023

(54) PRINTING SYSTEM AND PRINTING DEVICE

(71) Applicant: SEIKO EPSON CORPORATION, Tokyo (JP)

(72) Inventors: Shinya Yamagata, Matsumoto (JP); Yoshiharu Mizuno, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 70 days.

(21) Appl. No.: 17/591,815

(22) Filed: Feb. 3, 2022

(65) Prior Publication Data

US 2022/0242132 A1 Aug. 4, 2022

(30) Foreign Application Priority Data

Feb. 4, 2021 (JP) ..... 2021-016463

(51) Int. Cl.
*B41J 2/175* (2006.01)

(52) U.S. Cl.
CPC ..... *B41J 2/17509* (2013.01); *B41J 2/17566* (2013.01); *B41J 2002/17569* (2013.01); *B41J 2002/17589* (2013.01)

(58) Field of Classification Search
CPC ..... B41J 2/17509; B41J 2/17566; B41J 2002/17569; B41J 2002/17589
See application file for complete search history.

(56) References Cited

U.S. PATENT DOCUMENTS 6,786,566 B2 * 9/2004 Shindo ..... B41J 2/1652 347/29

FOREIGN PATENT DOCUMENTS

JP 2020-077207 A 5/2020

* cited by examiner

*Primary Examiner* — Justin Seo
(74) *Attorney, Agent, or Firm* — Oliff PLC

(57) ABSTRACT

A printing device includes a printing unit configured to use ink stored in an ink cartridge to perform printing on a medium, a remaining amount detector configured to detect a remaining amount of the ink stored in the ink cartridge, a maintenance unit configured to perform maintenance on the printing unit, and a display unit configured to perform predetermined notification regarding either replacement of the ink cartridge or refilling of the ink cartridge with the ink. Either the printing device or a server device includes a selector configured to select either the maintenance to be performed or the predetermined notification based on the remaining amount of the ink when an amount of the ink used for a predetermined time period is equal to or smaller than a defined amount based on information on the amount of the ink used.

8 Claims, 12 Drawing Sheets

FIG. 5

USER INFORMATION DATABASE

DB

| USER | DEVICE IDENTIFIER | DEVICE TYPE | COMMUNICATION DESTINATION | SUBSCRIPTION | DELIVERY DESTINATION | STANDARD AMOUNT OF INK TO BE USED PER PREDETERMINED TIME PERIOD | MAINTENANCE | | USED INK HISTORY | | | AMOUNT OF INK USED PER PREDETERMINED TIME PERIOD | UNUSED TIME PERIOD |
|---|---|---|---|---|---|---|---|---|---|---|---|---|---|
| | | | | | | | TYPE | AMOUNT OF INK USED | TIME INFORMATION | AMOUNT OF INK USED | REMAINING AMOUNT | | |
| USER A | DEVICE IDENTIFIER A | DEVICE TYPE A | COMMUNICATION DESTINATION A | VALID | DELIVERY DESTINATION A | STANDARD AMOUNT A | TYPE A1 | AMOUNT A1 OF INK USED | TIME INFORMATION A1 | AMOUNT A1 OF INK USED | REMAINING AMOUNT A1 | AMOUNT A OF INK USED | UNUSED TIME PERIOD A |
| | | | | | | | TYPE A2 | AMOUNT A2 OF INK USED | ... | ... | ... | | |
| | | | | | | | — | — | TIME INFORMATION A2 | AMOUNT A2 OF INK USED | REMAINING AMOUNT A2 | | |
| USER B | DEVICE IDENTIFIER B | DEVICE TYPE B | COMMUNICATION DESTINATION B | VALID | DELIVERY DESTINATION B | STANDARD AMOUNT B | TYPE B1 | AMOUNT B1 OF INK USED | TIME INFORMATION B1 | AMOUNT B1 OF INK USED | REMAINING AMOUNT B1 | AMOUNT B OF INK USED | UNUSED TIME PERIOD B |
| | | | | | | | TYPE B2 | AMOUNT B2 OF INK USED | ... | ... | ... | | |
| | | | | | | | — | — | TIME INFORMATION B2 | AMOUNT B2 OF INK USED | REMAINING AMOUNT B2 | | |
| ... | ... | ... | ... | ... | ... | ... | ... | ... | ... | ... | ... | ... | ... |

PRINTING SYSTEM AND PRINTING DEVICE

The present application is based on, and claims priority from JP Application Serial Number 2021-016463, filed Feb. 4, 2021, the disclosure of which is hereby incorporated by reference herein in its entirety.

BACKGROUND

1. Technical Field

The present disclosure relates to a printing system and a printing device that use a print material to perform printing on a medium.

2. Related Art

Conventionally, as a type of printing devices, printing devices, each of which uses a print material stored in a storage body to perform printing on a medium, are known. Among such printing devices, there is a printing device that performs maintenance on a printing unit that uses a print material to perform printing on a medium. In addition, among such printing devices, there is a printing device that performs notification regarding either replacement of a storage body or refilling of the storage body with a print material when a remaining amount of the print material stored in the storage body is small.

Regarding such printing devices, for example, JP-A-2020-77207 discloses a printing device configured to be able to communicate with a server device. JP-A-2020-77207 also discloses a printing system in which, when the amount of a print material used for a predetermined time period exceeds a predetermined amount in the printing device, a print material is delivered. This makes it possible to suppress shortage of the print material even when it is estimated that the amount of the print material used has rapidly increased.

However, in the printing device, when the frequency of use of the print material is low, the print material previously used may adhere to a printing unit and coagulate or the like to deteriorate the printing quality.

SUMMARY

According to an aspect of the present disclosure, in order to solve the foregoing problems, a printing system includes a printing device configured to use a print material to perform printing on a print medium, and a server device configured to communicate with the printing device via a network. In the printing system that manages the print material that is used by the printing device, the printing device includes a printing unit configured to use the print material stored in a storage body to perform the printing on the print medium, a remaining amount detector configured to detect a remaining amount of the print material stored in the storage body, a maintenance unit configured to perform maintenance on the printing unit, and a notifying unit configured to perform predetermined notification regarding either replacement of the storage body or refilling of the storage body with the print material. Either the printing device or the server device includes a selector configured to select either the maintenance to be performed on the printing unit by the maintenance unit or the predetermined notification by the notifying unit based on the remaining amount of the print material detected by the remaining amount detector when an amount of the print material used for a predetermined time period is equal to or smaller than a defined amount based on information on the amount of the print material used.

According to another aspect of the present disclosure, in order to solve the foregoing problems, a printing device that uses a print material to perform printing on a medium includes a printing unit configured to use the print material stored in a storage body to perform the printing on the medium, a remaining amount detector configured to detect a remaining amount of the print material stored in the storage body, a maintenance unit configured to perform maintenance on the printing unit, a notifying unit configured to perform predetermined notification regarding either replacement of the storage body or refilling of the storage body with the print material, and a selector configured to select either the maintenance to be performed on the printing unit by the maintenance unit or the predetermined notification by the notifying unit based on the remaining amount of the print material detected by the remaining amount detector when an amount of the print material used for a predetermined time period is equal to or smaller than a defined amount based on information on the amount of the print material used.

BRIEF DESCRIPTION OF THE DRAWINGS

FIG. 5 is a schematic diagram illustrating a user information database stored in a storage unit of a server device according to the first embodiment.

DESCRIPTION OF EXEMPLARY EMBODIMENTS

Hereinafter, a printing device 11 and a printing system 10 according to a first embodiment are described with reference to drawings.

Figure 1:
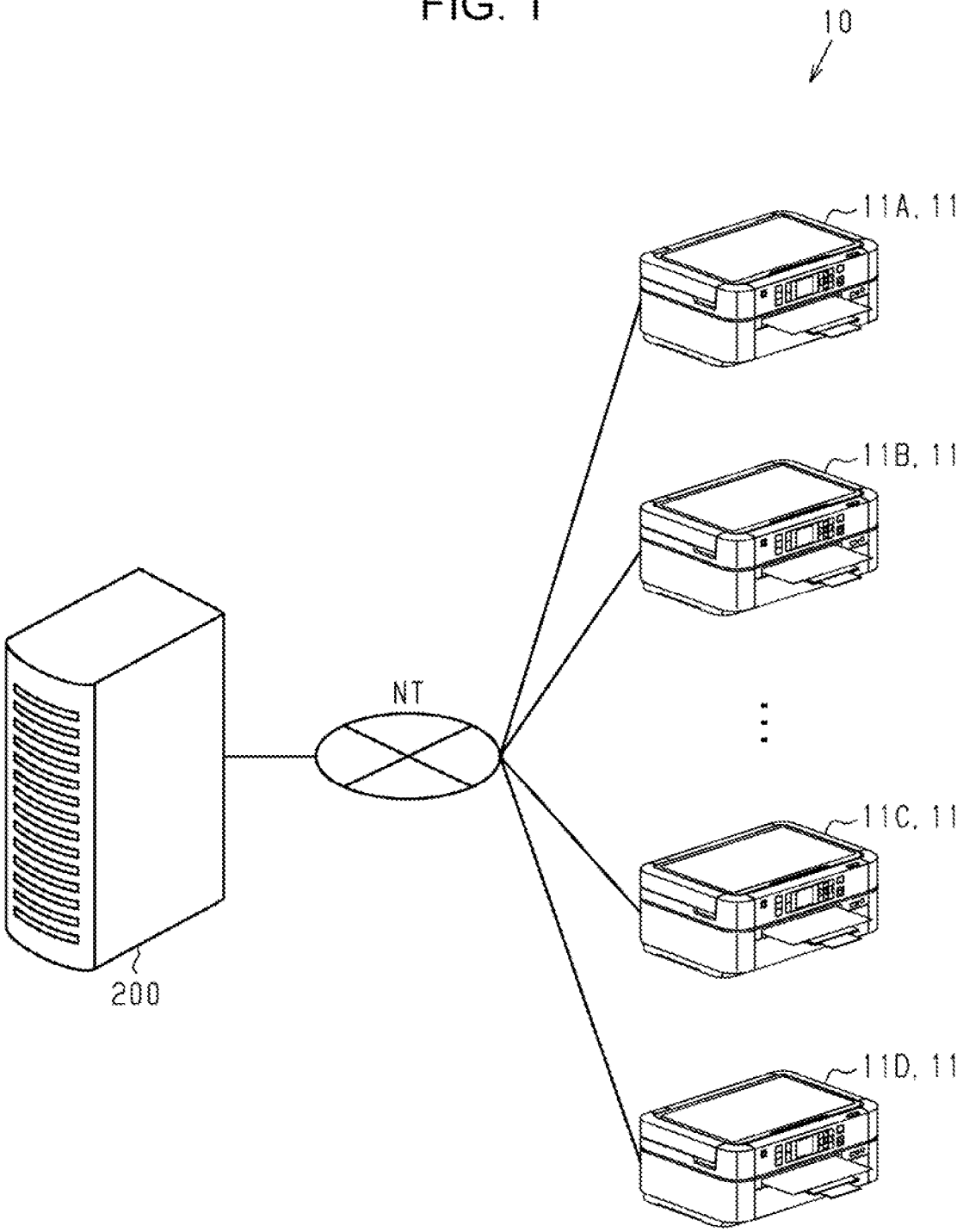
FIG. 1 is a schematic diagram illustrating a printing system according to a first embodiment.

As illustrated in FIG. 1, the printing system 10 includes a plurality of printing devices 11A to 11D and a server device 200. The printing devices 11A to 11D may be referred to as printing devices 11. In the present embodiment, the printing system 10 is configured to manage a print material such as ink to be used by the printing devices 11.

Each of the printing devices 11 uses the print material to perform printing on a medium M such as a paper sheet by ejecting the print material onto the medium M.

The server device 200 is communicably connected to the printing devices 11 via a network NT. Each of the printing devices 11 may be connected to the network NT via a host device (not illustrated) such as a personal computer, for example.

Figure 2:
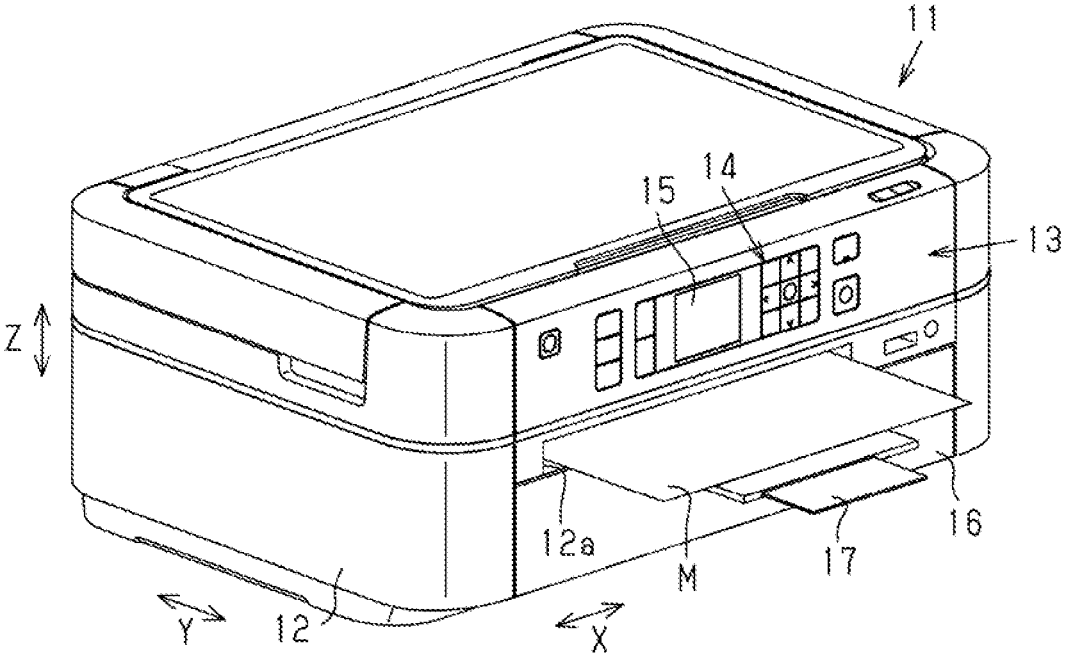
FIG. 2 is a perspective view illustrating a printing device according to the first embodiment.

As illustrated in FIG. 2, the printing device 11 includes a body 12 having a substantially rectangular box shape. The printing device 11 includes an operational panel 13. The operational panel 13 is mounted on an upper portion of a front surface of the body 12. The operational panel 13 includes an operational unit 14 and a display unit 15. The operational unit 14 can be operated by a user. The display unit 15 displays various images. In the present embodiment, the display unit 15 displays message information or the like that prompts to replace an ink cartridge 24 and perform maintenance, for example.

The printing device 11 includes a sheet feeding cassette 16. The sheet feeding cassette 16 is disposed on the lower side of the operational panel 13 of the body 12. The sheet feeding cassette 16 is detachably attached to the body 12. The sheet feeding cassette 16 is configured to store a plurality of media M such as paper sheets. The printing device 11 performs the printing on a medium M fed from the sheet feeding cassette 16.

The printing device 11 includes a sheet discharge port 12*a*. The sheet discharge port 12*a* is opened in the front surface of the body 12. The medium M after the printing is discharged from the sheet discharge port 12*a*. The printing device 11 includes a sheet discharge tray 17. The sheet discharge tray 17 is slidably disposed in the front surface of the body 12. The sheet discharge tray 17 holds the medium M discharged from the sheet discharge port 12*a* after the printing.

Figure 3:
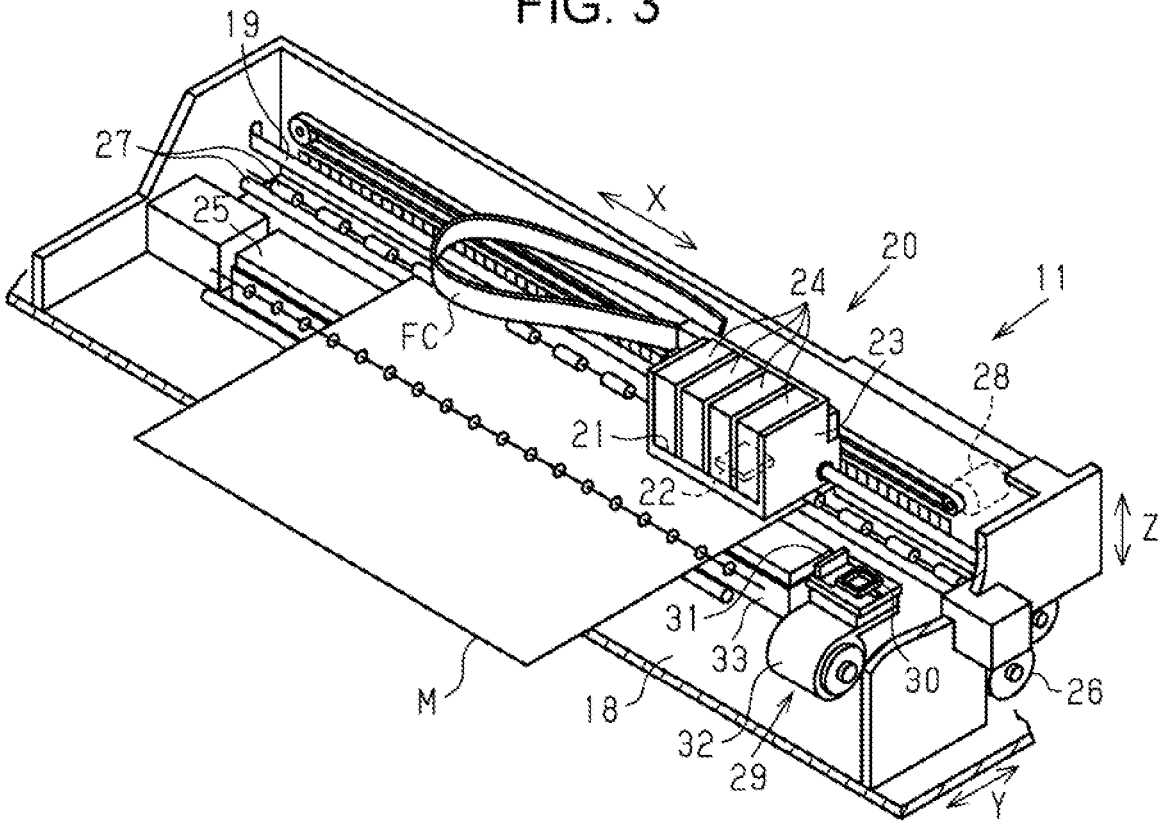
FIG. 3 is a perspective view illustrating the printing device according to the first embodiment.

As illustrated in FIG. 3, the printing device 11 includes a body frame 18. The body frame 18 has a substantially rectangular box shape and is exposed on the upper and front sides of the body frame 18. The printing device 11 includes a guide shaft 19. The guide shaft 19 is installed between a left side wall of the body frame 18 and a right side wall of the body frame 18. The guide shaft 19 has a predetermined length.

The printing device 11 includes a printing unit 20. The printing unit 20 uses the ink to perform printing on the medium M. The printing unit 20 includes a carriage 21. The carriage 21 is configured to reciprocate along the guide shaft 19 in a width direction X. The printing unit 20 includes a liquid ejecting head 22. The liquid ejecting head 22 is disposed under the carriage 21.

The printing unit 20 includes a cartridge holder 23. The cartridge holder 23 is disposed on the carriage 21. The carriage holder 23 is configured such that a plurality of ink cartridges 24 is attachable to the cartridge holder 23. In the present embodiment, the carriage holder 23 is configured such that four ink cartridges 24 are attachable to the cartridge holder 23. In the present embodiment, for example, ink of four colors, black (K), cyan (C), magenta (M), and yellow (Y) is stored in the four cartridges 24. The number of ink cartridges 24 that are attachable to the cartridge holder 23 is not limited to four. The cartridge holder 23 may be configured such that one, two, three, five, or more ink cartridges 24 are attachable to the cartridge holder 23. Ink of one, two, three, five, or more colors may be stored in one, two, three, five, or more ink cartridges 24. That is, in the present embodiment, each of the ink cartridges 24 corresponds to an example of a storage body in which a print material is stored.

Figure 4:
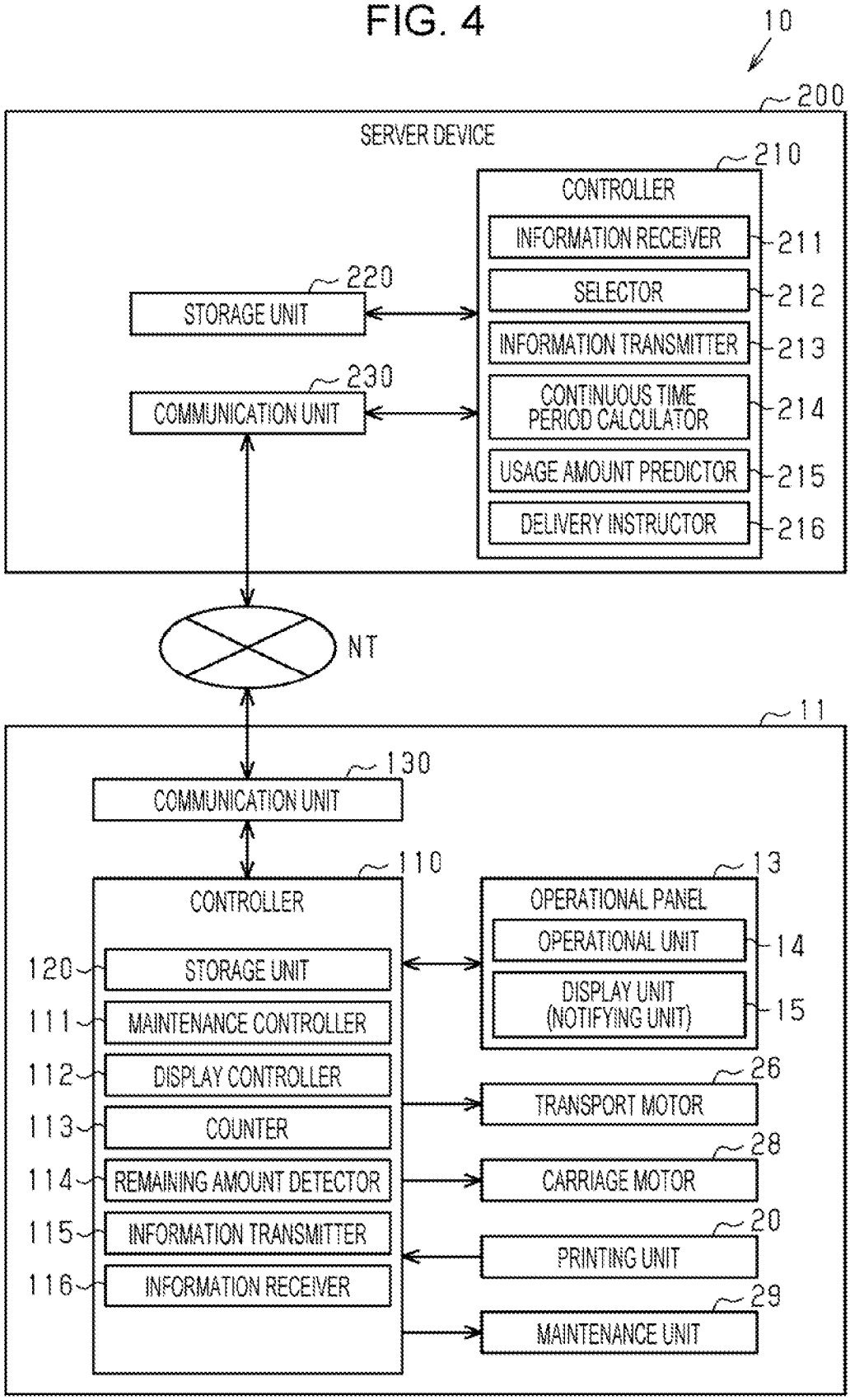
FIG. 4 is a block diagram illustrating an electric configuration of the printing system according to the first embodiment.

The liquid ejecting head 22 ejects the ink supplied from the ink cartridges 24 from nozzles opened in a lower surface of the liquid ejecting head 22 and provided for the colors. In this manner, the liquid ejecting head 22 performs the printing by ejecting the ink stored in the ink cartridges 24 attached to the cartridge holder 23. The liquid ejecting head 22 is communicably connected to a controller 110 included in the printing device 11 via a flexible flat cable FC coupled to the carriage 21. FIG. 4 illustrates the controller 110. The liquid ejecting head 22 is driven based on ejection control data from the controller 110.

The printing device 11 includes a support base 25. The support base 25 is disposed at a lower position than the liquid ejecting head 22 and faces the liquid ejecting head 22. The support base 25 has a long shape. The support base 25 supports the medium M on an upper surface of the support base 25. The support base 25 is disposed so as to define a gap between the liquid ejecting head 22 and the medium M. The support base 25 extends over at least a print region in the width direction X. The printing device 11 prints a character or an image on the medium M by ejecting the ink from the nozzles opened in the lower surface of the liquid ejecting head 22 onto the medium M supported on the support base 25 such that the ejected ink lands on the medium M.

The printing device 11 includes a transport motor 26. The transport motor 26 is disposed on the body frame 18. The printing device 11 includes a pair of transport rollers 27. The pair of transport rollers 27 is disposed upstream of the support base 25 in a depth direction Y. The pair of transport rollers 27 is rotatably driven by the transport motor 26 to transport the medium M in the depth direction Y while holding the medium M between the transport rollers 27.

In the present embodiment, the printing device 11 is a serial type printing device. The serial type printing device 11 includes a carriage motor 28. In the printing device 11, the carriage motor 28 is disposed on the body frame 18. The carriage motor 28 is configured to enable the carriage 21 to reciprocate in the width direction X. The printing device 11 alternately repeats a printing operation of ejecting the ink onto the medium M from the nozzles of the liquid ejecting head 22 while causing the carriage 21 to reciprocate in the width direction X and a feeding operation of transporting the medium M by a predetermined transport distance in the depth direction Y. As a result, the printing device 11 prints a character or an image on the medium M. In the present embodiment, the width direction X in which the carriage 21 reciprocates is a scan direction and a main scan direction, while the depth direction Y in which the medium M is transported is a transport direction and a sub-scan direction.

The printing device 11 includes a maintenance unit 29. The maintenance unit 29 performs maintenance on the printing unit 20. In particular, in the present embodiment, the maintenance unit 29 performs maintenance on the liquid ejecting head 22. The maintenance unit 29 is disposed directly under a home position of the carriage 21. The home position of the carriage 21 is the position of one end of a movement path of the carriage 21. The home position of the carriage 21 is the position where the carriage 21 stands by when the printing is not performed. In the present embodiment, cleaning and wiping are performed as the maintenance.

The maintenance unit 29 includes a cap 30, a wiper 31, a maintenance pump 32, and a discharged liquid tank 33. The cap 30 is configured to move in a vertical direction Z. The cap 30 is configured to move upward and come into contact with a nozzle formation surface, which is the lower surface of the liquid ejecting head 22, when the carriage 21 is at the home position. The maintenance pump 32 forcibly suctions the ink from the nozzles of the liquid ejecting head 22 and discharges the suctioned ink. The discharged liquid tank 33 is disposed on the lower side of the support base 25. The discharged liquid tank 33 stores the ink suctioned from the nozzles of the liquid ejecting head 22 and discharged by the maintenance pump 32.

In the present embodiment, the cleaning is performed to drive the maintenance pump 32 in a state in which the cap 30 is in contact with the nozzle formation surface, forcibly suction the ink from the nozzles of the liquid ejecting head 22, and discharge the suctioned ink. The cleaning may be pressurized cleaning, instead of the suction cleaning.

In the present embodiment, in the cleaning, a predetermined amount of the ink is suctioned from the nozzles of the liquid ejecting head 22 and is consumed. The cleaning is performed to discharge, from the nozzles of the liquid ejecting head 22, thickened ink, an air bubble, or a foreign matter that may cause an ejection failure. This can prevent the nozzles from being clogged.

In the present embodiment, the cleaning includes different types of cleaning in which maintenance intensities are different. As one specific example, the cleaning includes normal cleaning and powerful cleaning. Either one or both of suction power and a suction time period in the powerful cleaning is or are different from either one or both of suction power and a suction time period in the normal cleaning, and an amount of the ink used for the powerful cleaning is larger than an amount of the ink used for the normal cleaning. In the present embodiment, the maintenance includes the normal cleaning and the powerful cleaning. In the powerful cleaning, the ink in an amount larger than the amount of the ink to be used for the normal cleaning is used. In the present embodiment, the normal cleaning corresponds to an example of first maintenance, and the powerful cleaning corresponds to an example of second maintenance.

The wiper 31 is formed of an elastic member such as rubber. The wiper 31 is configured to move in the vertical direction Z. In the wiping, the carriage 21 moves in the width direction X in a state in which the wiper 31 is in contact with the nozzle formation surface of the liquid ejecting head 22, and thereby causes the wiper 31 to wipe the nozzle formation surface.

Next, an electric configuration of the printing system 10 is described with reference to FIG. 4. The printing system 10 in which one printing device 11 is communicably connected to the server device 200 via the network NT is described below.

The printing device 11 includes the controller 110, a communication unit 130, the operational panel 13, the transport motor 26, the carriage motor 28, the printing unit 20, and the maintenance unit 29.

The controller 110 controls the printing device 11. The controller 110 is electrically coupled to the communication unit 130, the operational panel 13, the transport motor 26, the carriage motor 28, the printing unit 20, and the maintenance unit 29.

The controller 110 includes a CPU, an application specific integrated circuit (ASIC), and a storage unit 120. The CPU executes a control program stored in the storage unit 120, thereby controlling the printing device 11. In particular, the controller 110 performs control regarding the printing by the printing unit 20.

The storage unit 120 includes a RAM, a nonvolatile memory, and the like. In the storage unit 120, information for controlling the printing device 11 by the controller 110 is stored. In particular, the control program and reference data are stored in the storage unit 120. The control program is executed to control the printing device 11. The reference data is referenced to control the printing device 11.

The communication unit 130 is communicably connected to the server device 200 via the network NT. The transport motor 26 is an actuator that transports the medium M in accordance with a control signal from the controller 110. The carriage motor 28 is an actuator that causes the carriage 21 to reciprocate in the width direction X in accordance with a control signal from the controller 110. When the printing device is a line printer, the printing device may not include the carriage motor 28. The printing unit 20 ejects the ink onto the medium M in accordance with a control signal from the controller 110.

The controller 110 executes the control program, thereby functioning as a maintenance controller 111, a display controller 112, a counter 113, a remaining amount detector 114, an information transmitter 115, and an information receiver 116.

The maintenance controller 111 causes the maintenance unit 29 to perform the maintenance on the printing unit 20. In the present embodiment, the maintenance controller 111 causes the maintenance unit 29 to perform the normal cleaning. In the present embodiment, the maintenance controller 111 causes the maintenance unit 29 to perform the powerful cleaning. In the present embodiment, the maintenance controller 111 causes the maintenance unit 29 to perform the wiping.

In the present embodiment, although the maintenance controller 111 causes the maintenance unit 29 to perform the maintenance in accordance with an operation of the operational unit 14, the maintenance controller 111 may cause the maintenance unit 29 to perform the maintenance in accordance with an instruction from the server device 200. In the case where the maintenance controller 111 causes the maintenance unit 29 to perform the maintenance in accordance with the operation of the operational unit 14, the maintenance controller 111 may select a maintenance intensity based on nozzle detection of the liquid ejecting head 22 or the like.

The display controller 112 performs control to cause the display unit 15 to display an image. In the present embodiment, the display controller 112 causes the display unit 15 to display message information or the like that prompts to replace an ink cartridge and perform the maintenance. That is, in the present embodiment, the display unit 15 functions as a notifying unit configured to perform predetermined notification regarding the replacement of an ink cartridge.

The counter 113 counts an amount of the ink used during the printing or during the maintenance. In the present embodiment, the ink used includes the ink ejected from the liquid ejecting head 22 during the printing. In the present embodiment, the counter 113 counts an amount of the ink used for each of the colors of the ink based on image data used during the printing. In the present embodiment, the ink used includes the ink suctioned from the liquid ejecting head 22 by the various types of cleaning performed during the maintenance. In the present embodiment, the counter 113 counts, as the amount of the ink used, a predetermined amount corresponding to the type of maintenance performed in the maintenance.

The counter 113 causes the counted amount of the ink to be cumulatively stored in the storage unit 120. Therefore, the counter 113 can identify an amount of the ink used per predetermined time period. In the present embodiment, the predetermined time period is a time period corresponding to 30 days, but is not limited thereto. For example, it is preferable that the predetermined time period be 30 days or longer. In the present embodiment, a time period from the time earlier than the current time by the predetermined time period to the current time corresponds to the predetermined time period.

The remaining amount detector 114 detects a remaining amount of the ink stored in each of the ink cartridges 24. In the present embodiment, the remaining amount detector 114 is configured to access each of memory elements of the ink cartridges 24. Each of the ink cartridges 24 is configured to store information indicating a remaining amount of the ink in the memory element of the ink cartridge 24. The remaining amount detector 114 reads information identifying a remaining amount of the ink from each of the ink cartridges 24 at the time of a power-on process of the printing device 11. When the ink is used, the remaining detector 114 acquires information indicating an amount of the ink used that has been counted by the counter 113. When the ink is used, the remaining amount detector 114 reads information identifying a remaining amount of the ink from each of the ink cartridges 24 and calculates the currently remaining amount of the ink by subtracting the amount of the ink used from the amount of the ink before the use of the ink. The remaining amount detector 114 writes the information indicating the calculated remaining amounts of the ink to the memory elements of the ink cartridges 24. Therefore, the remaining amount detector 114 can detect the remaining amounts of the ink stored in the ink cartridges 24.

The information transmitter 115 transmits various information to the server device 200. In particular, the information transmitter 115 transmits information on amounts of the ink used to the server device 200. In the present embodiment, the information on the amounts of the ink used includes amounts of the ink used for the printing, the maintenance, and the like, and the remaining amounts of the ink stored in the ink cartridges 24.

When a remaining amount of the ink stored in any of the ink cartridges 24 reaches a predetermined lower limit, the information transmitter 115 transmits delivery request information to the server device 200. The delivery request information is information that requests for delivery of an ink cartridge 24.

The information receiver 116 receives various information from the server device 200. In the present embodiment, the various information received from the server device 200 includes information instructing to perform notification that prompts to replace an ink cartridge 24 or perform the maintenance, and information instructing to actually perform the maintenance. The information indicates a selection result that is a result of selection performed by the server device 200 based on information on an amount of the ink used.

The server device 200 includes a controller 210, a storage unit 220, and a communication unit 230. The controller 210 includes a CPU. The CPU executes a control program to control the server device 200.

The storage unit 220 includes a RAM, a nonvolatile memory, and the like. In the storage unit 220, information for controlling the server device 220 by the controller 210 is stored. In particular, in the storage unit 220, the control program and reference data are stored. The control program is executed to control the server device 200. The reference data is referenced to control the server device 200.

The communication unit 230 is communicably connected to another device such as the printing device 11 via the network NT.

The controller 210 executes the control program to function as an information receiver 211, a selector 212, an information transmitter 213, a continuous time period calculator 214, a usage amount predictor 215, and a delivery instructor 216.

The information receiver 211 receives information on an amount of the ink used from the printing device 11. In the present embodiment, the information receiver 211 corresponds to an example of a receiver.

The selector 212 is configured to select the maintenance to be performed on the printing unit 20 or predetermined notification regarding the use of the ink based on a remaining amount of the ink when the amount of the ink used by the printing device 11 for the predetermined time period is equal to or smaller than a standard amount serving as a standard. In particular, the selector 212 is configured to select the maintenance to be performed on the printing unit 20 when the remaining amount of the ink is equal to or larger than an amount required to perform the maintenance on the printing unit 20. On the other hand, the selector 212 is configured to select the predetermined notification regarding the use of the ink when the remaining amount of the ink is smaller than the amount required to perform the maintenance on the printing unit 20.

The information transmitter 213 transmits information on the selection result selected by the selector 212 to the printing device 11. In the present embodiment, the information transmitter 213 corresponds to an example of a transmitter.

The continuous time period calculator 214 calculates, based on the information transmitted from the printing device 11 and relating to the use of the ink, a continuous unused time period for which the ink is not used by the printing device 11.

The usage amount predictor 215 predicts an amount of the ink to be used by the printing device 11. In particular, in the present embodiment, the usage amount predictor 215 predicts, based on the unused time period calculated by the continuous time period calculator 214, an amount of the ink to be used for the maintenance to be performed next by the printing device 11.

The delivery instructor 216 instructs to deliver an ink cartridge 24 when a delivery condition for the ink cartridge 24 is established. In particular, in the present embodiment, when a remaining amount of ink stored in an ink cartridge 24 attached to the printing device 11 is smaller than the amount of ink to be used that has been predicted by the usage amount predictor 215, the delivery instructor 216 instructs to deliver an ink cartridge 24.

In the printing system 10 described above, information on the plurality of printing devices 11 included in the printing system 10 is managed as a user information database DB illustrated in FIG. 5 in the server device 200. In particular, in the present embodiment, the user information database DB is configured to manage amounts of the ink used by the printing devices 11 and remaining amounts of the ink stored in ink cartridges 24 attached to the printing devices 11.

In the present embodiment, the user information database DB is stored in the storage unit 220 of the server device 200. The user information database DB is an information group for managing the information on the printing devices 11.

As illustrated in FIG. 5, in the user information database DB, one user identifier information item is associated with one or multiple device identifier information items. The user identifier information item is user-specific identifier information identifying a user. The device identifier information items are device-specific identifier information identifying printing devices 11.

In the user information database DB, one device identifier information item is associated with device type information, device communication information, subscription information, and delivery destination information. The device type information identifies a model of a printing device 11 as the type of the printing device 11. The device communication information is information for communication with the printing device 11. The subscription information indicates whether subscription is valid or invalid. The subscription is a system in which a fee is charged for a period during which the printing system 10 can be used, regardless of an amount of the ink used. Therefore, the subscription is the system that does not directly affect the fee even when the amount of the ink used is large. The delivery destination information indicates a location where the printing device 11 is installed, and is provided to deliver an ink cartridge 24.

In the user information database DB, the one device identifier information item is associated with a standard amount of ink to be used per predetermined time period. The standard amount of ink to be used per predetermined time period is a standard for the minimum amount of the ink to be used per predetermined time period. When the amount of the ink used per predetermined time period is smaller than the standard amount, ink that has adhered to a nozzle of the liquid ejecting head 22 may change over time, and thickened ink, an air bubble, or a foreign matter may be generated to cause an ejection failure. In this case, the printing device 11 needs to perform the maintenance to suppress deterioration of the printing quality. In the user information database DB, it is possible to recognize the standard amount of ink to be used per predetermined time period. The standard amount of ink to be used per predetermined time period is information associated with the type of the printing device 11.

In the user information database DB, the one device identifier information item is associated with one or multiple types of maintenance information. The maintenance information includes the types of the maintenance and amounts of ink to be used for the maintenance. As a specific example, the types of the maintenance are the normal cleaning and the powerful cleaning. The normal cleaning is associated with the amount of ink to be used for the normal cleaning. The powerful cleaning is associated with the amount of ink to be used for the powerful cleaning. The amount of ink to be used for the powerful cleaning is larger than the amount of ink to be used for the normal cleaning. The maintenance information is associated with the type of the printing device 11.

In the user information database DB, the one device identifier information item is associated with one or multiple types of used ink history information. The used ink history information is history information of an amount of the ink used by the printing device 11. The used ink history information is transmitted from the printing device 11. The used ink history information is associated with time information, used ink amount information, and remaining ink amount information. The time information is information of the time when the information on the amount of the ink used by the printing device 11 is generated. The used ink amount information indicates the amount of the ink used by the printing device 11. The remaining ink amount information indicates a remaining amount of the ink stored in each ink cartridge 24 attached to the printing device 11. The remaining ink amount information associated with the latest time information can be recognized as the latest remaining ink amount information of the printing device 11.

In the user information database DB, the one device identifier information item is associated with an amount of the ink used per predetermined time period. The amount of the ink used per predetermined time period is information generated from the used ink history information.

Specifically, used ink amount information associated with time information indicating a time within the predetermined time period is extracted from the used ink history information, and the total of the extracted used ink amount information is calculated as the amount of the ink used per predetermined time period.

In the user information database DB, the one device identifier information item is associated with an unused time period. The unused time period is a time period for which the ink is not ejected from the printing device 11 and the amount of the ink used does not change. The unused time period is information generated from the used ink history information. Specifically, time information associated with used ink amount information changed is extracted from the used ink history information, and the difference between the extracted time information and the current time is calculated as the unused time period.

Various processes to be performed by the printing device 11 and the server device 200 in accordance with the control programs are described below.

First, a process of transmitting ink amount related information by the printing device 11 is described with reference to FIG. 6. The process of transmitting the ink amount related information is performed by the controller 110 of the printing device 11 at predetermined time intervals.

Figure 6:
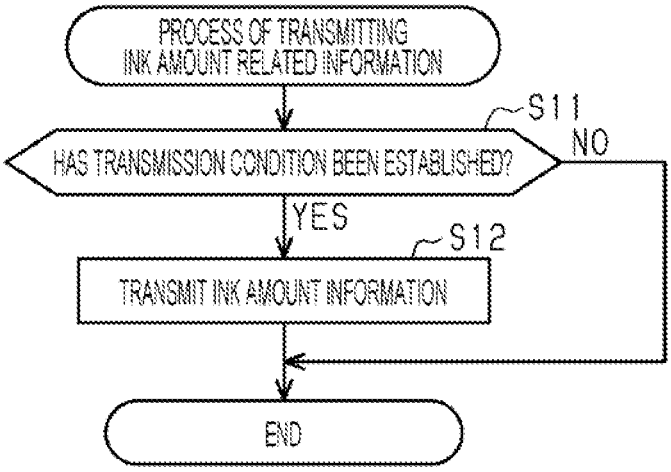
FIG. 6 is a flowchart illustrating a process of transmitting ink amount related information by a controller of the printing device.

As illustrated in FIG. 6, in step S11, the controller 110 determines whether a transmission condition has been established. In the present embodiment, the transmission condition is established at the time of power on of the printing device 11, the time of power off of the printing device 11, the end time of the printing, the end time of the maintenance, and the time of the replacement of an ink cartridge 24. When the controller 110 determines that the transmission condition has not been established, the controller 110 does not perform step S12 and ends the process of transmitting the ink amount related information. On the other hand, when the controller 110 determines that the transmission condition has been established, controller 110 causes the process to proceed to step S12.

In step S12, the controller 110 transmits the ink amount related information on an amount of the ink used. In the present embodiment, as the ink amount related information, the time information, the used ink amount information, the remaining ink amount information, and the delivery request information are used.

Specifically, the controller 110 acquires current time information from a timekeeper included in the controller 110. The controller 110 reads, from the memory element of each ink cartridge 24, a remaining amount of the ink stored in the ink cartridge 24 and generates the remaining ink amount information. In particular, when an amount of the ink is an amount that requires to deliver an ink cartridge 24, the controller 110 generates delivery request information. At the end time of the printing and the end time of the maintenance, the controller 110 generates used ink amount information indicating an amount of the ink used. The controller 110 transmits the generated various information to the server device 200 via the network NT. When this process is ended, the controller 110 ends the process of transmitting the ink amount related information.

Figure 9:
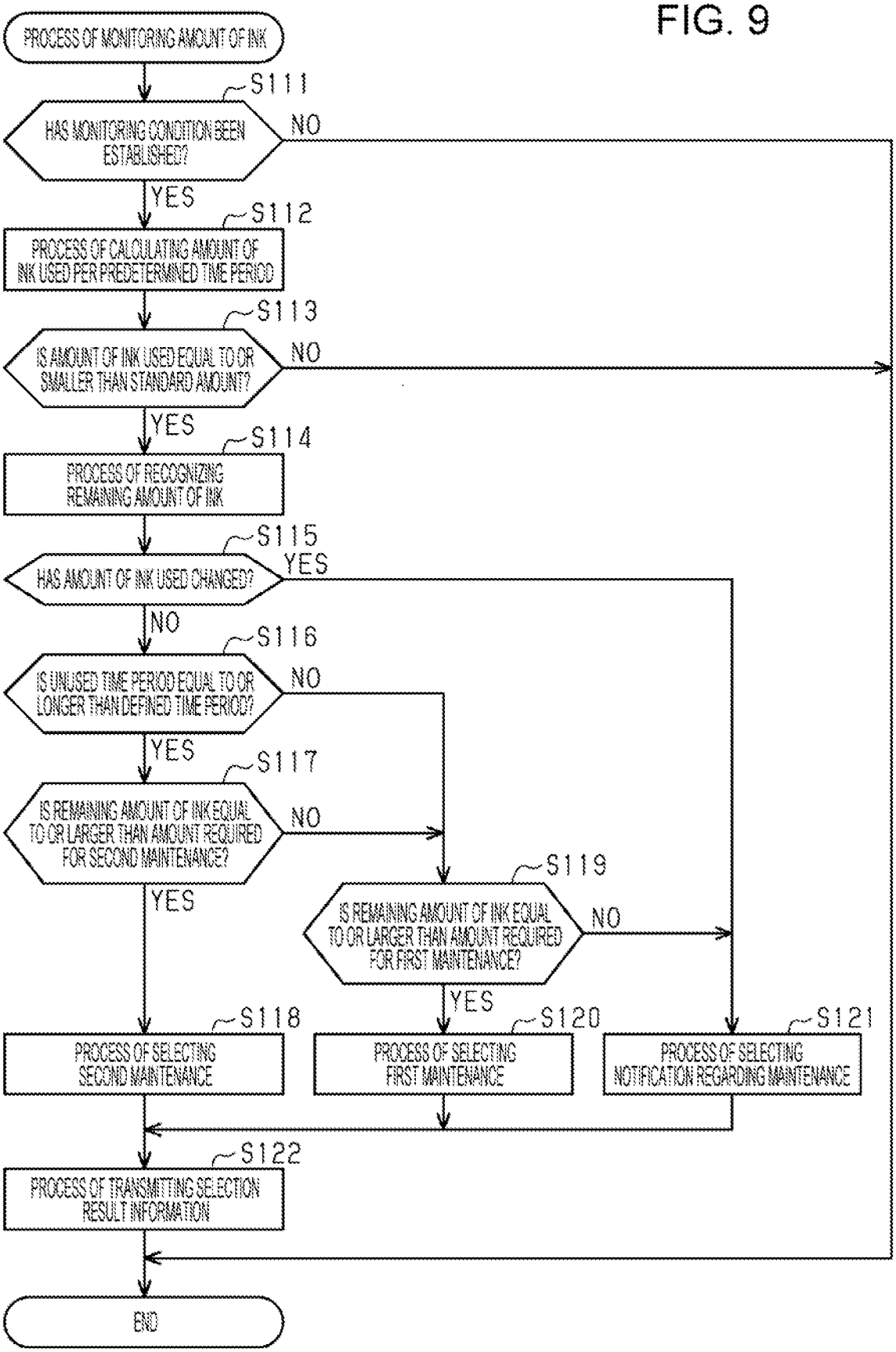
FIG. 9 is a flowchart illustrating a process of monitoring an amount of ink by the controller of the server device.

Next, a selection result control process to be performed by the printing device 11 is described with reference to FIG. 7. The selection result control process is performed by the controller 110 of the printing device 11 when the printing device 11 receives selection result information from the server device 200. In particular, the selection result control process is performed based on information of a selection result selected by the server device 200 based on a selection standard. In the present embodiment, the selection standard is described together with a process of monitoring an amount of ink as illustrated in FIG. 9, but includes information indicating whether an amount of the ink used has changed. In the present embodiment, the selection standard includes information indicating whether the unused time period is equal to or longer than a time period after which the second maintenance is recommended to be performed. In the present embodiment, the selection standard includes information indicating whether a remaining amount of ink is equal to or larger than an amount of ink required for each type of the maintenance.

Figure 7:
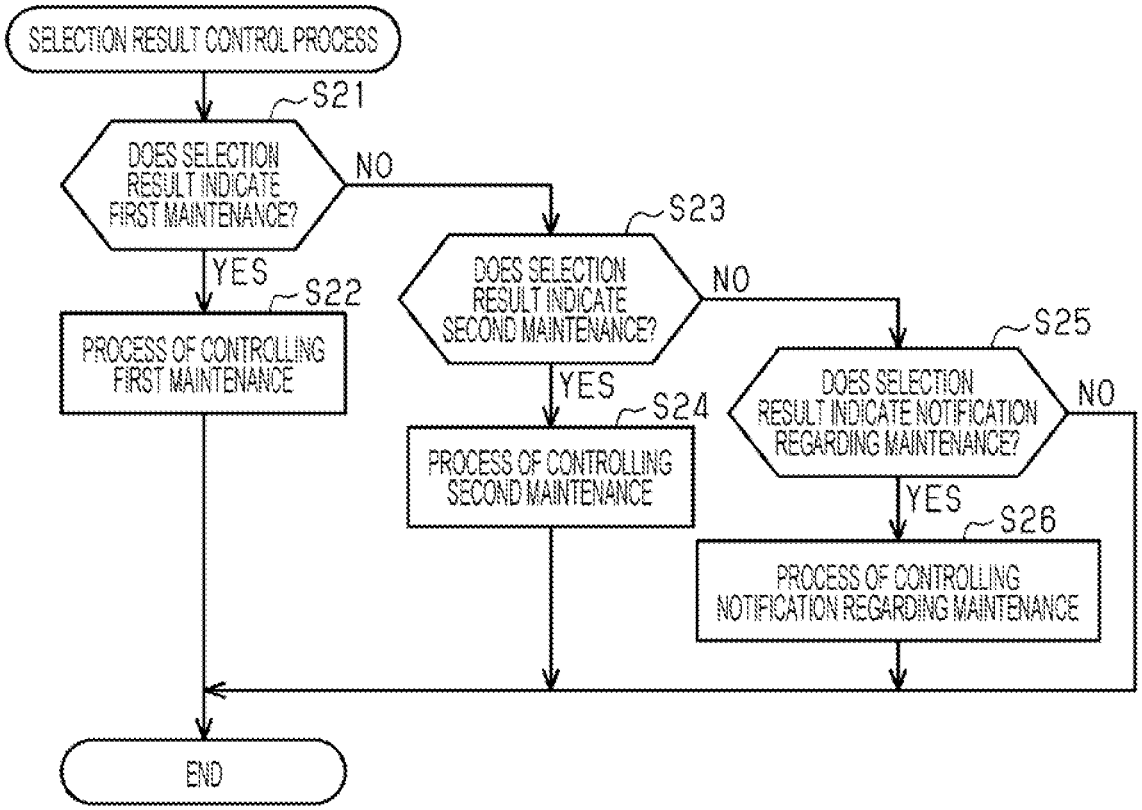
FIG. 7 is a flowchart illustrating a selection result control process to be performed by the controller of the printing device.

As illustrated in FIG. 7, in step S21, the controller 110 determines, based on the selection result information received from the server device 200, whether the selection result indicates the first maintenance. In the present embodiment, the first maintenance corresponds to the normal cleaning. When the controller 110 determines that the selection result does not indicate the first maintenance, the controller 110 causes the process to proceed to step S23. On the other hand, when the controller 110 determines that the selection result indicates the first maintenance, the controller 110 causes the process to proceed to step S22.

In step S22, the controller 110 performs a process of controlling the first maintenance. In the process of controlling the first maintenance, the controller 110 causes information indicating the first maintenance to be performed to be stored in the storage unit 120. Therefore, the controller 110 causes the maintenance unit 29 to perform the normal cleaning as the first maintenance at a predetermined time. In the present embodiment, the predetermined time corresponds to the time of power off of the printing device 11, but is not limited thereto. For example, the predetermined time may be the time of power on of the printing device 11, the end time of the printing, or the time when a predetermined time period elapses. The controller 110 that performs this process functions as the maintenance controller 111. When the process is ended, the controller 110 ends the selection result control process.

In step S23, the controller 110 determines, based on the selection result information received from the server device 200, whether the selection result indicates the second maintenance. In the present embodiment, the second maintenance corresponds to the powerful cleaning. When the controller 110 determines that the selection result does not indicate the second maintenance, the controller 110 causes the process to proceed to step S25. On the other hand, when the controller 110 determines that the selection result indicates the second maintenance, the controller 110 causes the process to proceed to step S24.

In step S24, the controller 110 performs a process of controlling the second maintenance. In this process, the controller 110 causes information indicating the second maintenance to be performed to be stored in the storage unit 120. Therefore, the controller 110 causes the maintenance unit 29 to perform the powerful cleaning as the second maintenance at a predetermined time. The controller 110 that performs this process functions as the maintenance controller 111. When this process is ended, the controller 110 ends the selection result control process.

In step S25, the controller 110 determines, based on the selection result information received from the server device 200, whether the selection result indicates notification regarding the maintenance. In the present embodiment, the notification regarding the maintenance corresponds to notification that prompts to replace an ink cartridge 24 or to perform the cleaning. When the controller 110 determines that the selection result does not indicate the notification regarding the maintenance, the controller 110 does not perform step S26 and ends the selection result control process. On the other hand, when the controller 110 determines that the selection result indicates the notification regarding the maintenance, the controller 110 causes the process to proceed to step S26.

In step S26, the controller 110 performs a process of controlling the notification regarding the maintenance. In this process, the controller 110 causes information indicating the notification to be performed regarding the maintenance to be stored in the storage unit 120. Then, the controller 110 causes the display unit 15 to perform the notification regarding the maintenance. The controller 110 that performs this process functions as the display controller 112. When this process is ended, the controller 110 ends the selection result control process.

In the present embodiment, the controller 110 causes the maintenance unit 29 to perform the maintenance on the printing unit 20 or causes the display unit 15 to perform the predetermined notification based on the selection result information transmitted from the server device 200 and relating to the selection result.

Next, a process of receiving the ink amount related information by the server device 200 is described with reference to FIG. 8. The process of receiving the ink amount related information is performed by the controller 210 of the server device 200 at predetermined time intervals.

Figure 8:
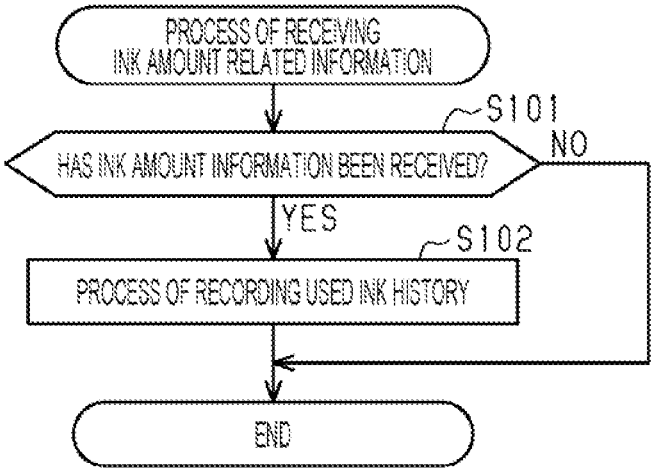
FIG. 8 is a flowchart illustrating a process of receiving the ink amount related information by a controller of the server device.

As illustrated in FIG. 8, in step S101, the controller 210 determines whether the controller 210 has received the ink amount related information from the printing device 11. The controller 210 that performs this process functions as the information receiver 211. When the controller 210 determines that the controller 210 has not received the ink amount related information from the printing device 11, the controller 210 does not perform step S102 and ends the process of receiving the ink amount related information. On the other hand, when the controller 210 determines that the controller 210 has received the ink amount related information from the printing device 11, the controller 210 causes the process to proceed to step S102.

In step S102, the controller 210 performs a process of recording a used ink history. After step S102, the controller 210 ends the process of receiving the ink amount related information. In the process of recording a used ink history, the controller 210 causes new information to be stored in the used ink history information of the user information database DB based on the ink amount related information received from the printing device 11. In the present embodiment, after receiving delivery request information as the ink amount related information, the controller 210 causes information indicating that a delivery request has been provided to be stored in the storage unit 220. Therefore, the controller 210 can recognize that the delivery request has been provided.

Next, the process of monitoring an amount of ink by the server device 200 is described with reference to FIG. 9. The process of monitoring an amount of ink is performed by the controller 210 of the server device 200 at predetermined time intervals.

As illustrated in FIG. 9, in step S111, the controller 210 determines whether a monitoring condition has been established. In the present embodiment, the monitoring condition is established at time intervals shorter than the predetermined time period, but is not limited thereto. For example, the monitoring condition may be established when the predetermined time period elapses. When the controller 210 determines that the monitoring condition has not been established, the controller 210 does not perform steps S112 to S122 and ends the process of monitoring an amount of ink. On the other hand, when the controller 210 determines that the monitoring condition has been established, the controller 210 causes the process to proceed to step S112.

In step S112, the controller 210 performs a process of calculating an amount of the ink used per predetermined time period. In this process, the controller 210 references the used ink history information of the user information database DB and calculates the amount of the ink used per predetermined time period. Specifically, the controller 210 references the time information of the used ink history information of the user information database DB. The controller 210 extracts amounts of the ink used in the predetermined time period based on time information indicating a time period from the time earlier than the current time by the predetermined time period to the current time indicated by the current time information. The controller 210 sums the extracted amounts of the ink used to calculate the amount of the ink used per predetermined time period. The controller 210 causes the calculated amount of the ink used per predetermined time period to be stored in the user information database DB. When this process is ended, the controller 210 causes the process to proceed to step S113.

In step S113, the controller 210 references the user information database DB and determines whether the calculated amount of the ink used per predetermined time period is equal to or smaller than the standard amount. When the controller 210 determines that the amount of the ink used per predetermined time period is larger than the standard amount, the controller 210 does not perform steps S114 to S122 and ends the process of monitoring an amount of ink. On the other hand, when the controller 210 determines that the amount of the ink used per predetermined time period is equal to or smaller than the standard amount, the controller 210 causes the process to proceed to step S114. In the present embodiment, the standard amount of ink to be used per predetermined time period corresponds to an example of a defined amount.

In step S114, the controller 210 performs a process of recognizing a remaining amount of the ink. In this process, the controller 210 references the used ink history information of the user information database DB and recognizes a remaining amount associated with the latest time information as a current remaining amount of the ink. When this process is ended, the controller 210 causes the process to proceed to step S115.

In step S115, the controller 210 determines whether the amount of the ink used per predetermined time period has changed. When the controller 210 determines that the amount of the ink used per predetermined time period has not changed, the controller 210 causes the process to proceed to step S116. On the other hand, when the controller 210 determines that the amount of the ink used per predetermined time period has changed, the controller 210 causes the process to proceed to step S121.

In step S116, the controller 210 references the user information database DB and determines whether the unused time period is equal to or longer than a defined time period. In the predetermined embodiment, as the defined time period, a time period after which the powerful cleaning is recommended to be performed is defined. When the controller 210 determines that the unused time period is equal to or longer than the defined time period, the controller 210 causes the process to proceed to step S117. On the other hand, when the controller 210 determines that the unused time period is shorter than the defined time period, the controller 210 causes the process to proceed to step S118.

In step S117, the controller 210 determines whether the recognized remaining amount of the ink is equal to or larger than the amount of ink required for the second maintenance. In the present embodiment, the second maintenance corresponds to the powerful cleaning. When the controller 210 determines that the remaining amount of the ink is equal to or larger than the amount of ink required for the second maintenance, the controller 210 causes the process to proceed to step S118. On the other hand, when the controller 210 determines that the remaining amount of the ink is smaller than the amount of ink required for the second maintenance, the controller 210 causes the process to proceed to step S119.

In step S118, the controller 210 performs a process of selecting the second maintenance. In this process, the controller 210 selects the second maintenance to be performed as a selection result and causes the process to proceeds to step S122.

That is, the controller 210 is configured to select the maintenance to be performed on the printing unit 20 when the amount of the ink used for the predetermined time period is equal to or smaller than the standard amount and the remaining amount of the ink is equal to or larger than the amount required to perform the maintenance on the printing unit 20. In particular, in the present embodiment, the controller 210 is configured to select the second maintenance to be performed when the unused time period is equal to or longer than the defined time period and the remaining amount of the ink is equal to or larger than the amount required to perform the second maintenance.

In step S119, the controller 210 determines whether the recognized remaining amount of the ink is equal to or larger than the amount of ink required for the first maintenance. In the present embodiment, the first maintenance corresponds to the normal cleaning. When the controller 210 determines that the remaining amount of the ink is equal to or larger than the amount of ink required for the first maintenance, the controller 210 causes the process to proceed to step S120. On the other hand, when the controller 210 determines that the remaining amount of the ink is smaller than the amount of ink required for the first maintenance, the controller 210 causes the process to proceed to step S121.

In step S120, the controller 210 performs a process of selecting the first maintenance. In this process, the controller 210 selects the first maintenance to be performed as a selection result and causes the process to proceed to step S122.

That is, the controller 210 is configured to select the maintenance to be performed on the printing unit 20 when the amount of the ink used for the predetermined time period is equal to or smaller than the standard amount and the remaining amount of the ink is equal to or larger than the amount required to perform the maintenance on the printing unit 20. In particular, in the present embodiment, the controller 210 is configured to select the first maintenance to be performed when the unused time period is equal to or longer than the defined time period and the remaining amount of the ink is equal to or larger than the amount required to perform the first maintenance and is smaller than the amount required to perform the second maintenance.

In step S121, the controller 210 performs a process of selecting the notification regarding the maintenance. In this process, the controller 210 selects the notification to be performed regarding the maintenance as a selection result and causes the process to proceed to step S122.

That is, the controller 210 is configured to select the predetermined notification regarding the replacement of an ink cartridge 24 and the maintenance to be performed or the like when the amount of the ink used for the predetermined time period is equal to or smaller than the standard amount and the remaining amount of the ink is smaller than the amount required to perform the maintenance on the printing unit 20. In particular, in the present embodiment, the controller 210 is configured to select the first maintenance to be performed on the printing unit 20 when the unused time period is equal to or longer than the defined time period and the remaining amount of the ink is smaller than the amount required to perform the second maintenance and is equal to or larger than the amount required to perform the first maintenance.

In this manner, the controller 210 is configured to select either the maintenance to be performed on the printing unit 20 or the predetermined notification based on the remaining amount of the ink when the amount of the ink used for the predetermined time period is equal to or smaller than the standard amount based on information on the amount of the ink used. In addition, the controller 210 selects either the maintenance to be performed on the printing unit 20 or the predetermined notification based on whether the amount of the ink used per predetermined time period has changed. That is, the controller 210 is configured to select either the maintenance to be performed on the printing unit 20 or the predetermined notification based on the amount of the ink used for the predetermined time period when the amount of the ink used for the predetermined time period is equal to or smaller than the defined amount. In the present embodiment, the controller 210 that performs this process functions as the selector 212.

In step S122, the controller 210 generates selection result information indicating the selection result selected and transmits the generated selection result information to the printing device 11 via the network NT. The controller 210 that performs this process functions as the information transmitter 213. When this process is ended, the controller 210 ends the process of monitoring an amount of ink.

Next, a delivery management process to be performed by the server device 200 is described with reference to FIG. 10. The delivery management process is performed by the controller 210 of the server device 200 at predetermined time intervals.

Figure 10:
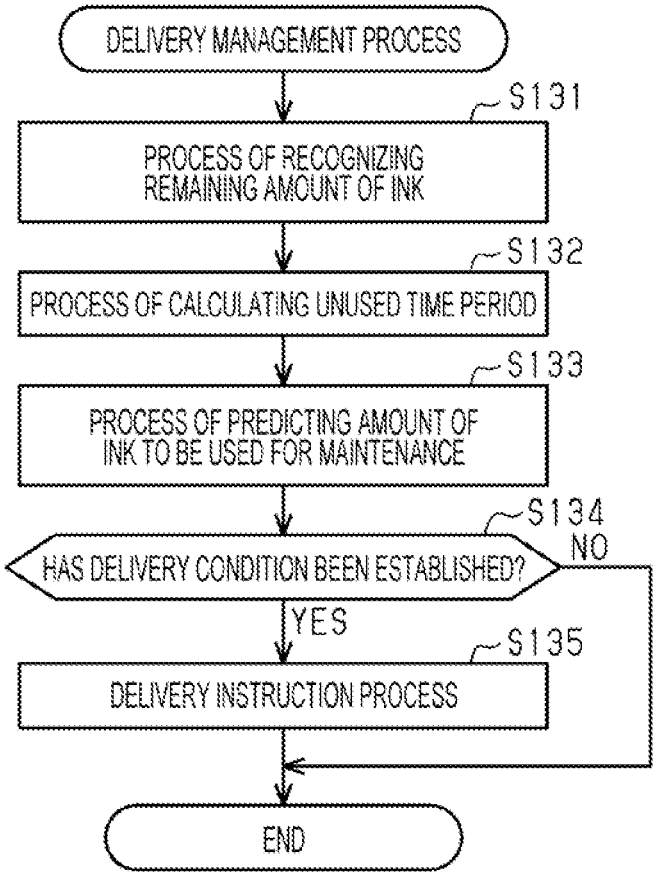
FIG. 10 is a flowchart illustrating a delivery management process to be performed by the controller of the server device.

As illustrated in FIG. 10, in step S131, the controller 210 performs a process of recognizing a remaining amount of the ink in the same manner as step S114 and causes the process to proceed to step S132.

In step S132, the controller 210 performs a process of calculating the unused time period. In this process, the controller 210 references the used ink history information of the user information database DB and calculates the continuous unused time period for which the ink is not used by the printing device 11. The controller 210 registers the calculated unused time period in the user information database DB. In this manner, the controller 210 calculates the unused time period for which the ink is not used by the printing device 11. In the present embodiment, the controller 210 that performs this process functions as the continuous time period calculator 214. In the present embodiment, the unused time period for which the ink is not used corresponds to an example of a continuous time period. When this process is ended, the controller 210 causes the process to proceed to step S133.

In step S133, the controller 210 performs a process of predicting an amount of the ink to be used for the maintenance. In this process, the controller 210 references the unused time period registered in the user information database DB. When the unused time period is equal to or longer than the defined time period, the controller 210 predicts, as a predicted amount of ink to be used, the amount of ink required for the second maintenance. When the unused time period is shorter than the defined time period, the controller 210 predicts, as the predicted amount of ink to be used, the amount of ink required for the first maintenance. In this manner, the controller 210 predicts, based on the unused time period for which the ink is not used by the printing device 11, the amount of the ink to be used for the maintenance to be performed next by the maintenance unit 29. In the present embodiment, the controller 210 that performs this process functions as the usage amount predictor 215. When this process is ended, the controller 210 causes the process to proceed to step S134.

In step S134, the controller 210 determines whether a delivery condition has been established. In the present embodiment, the delivery condition is established when a delivery request is provided from the printing device 11. In the present embodiment, the delivery condition is established when the user information database DB is referenced and a remaining amount of the ink is smaller than the predicted amount of the ink to be used. When the controller 210 determines that the delivery condition has not been established, the controller 210 does not perform step S135 and ends the delivery management process. On the other hand, when the controller 210 determines that the delivery condition has been established, the controller 210 causes the process to proceed to step S135.

In step S135, the controller 210 performs a delivery instruction process. In this process, the controller 210 causes information, which indicates that an ink cartridge 24 is delivered to a delivery destination of the printing device 11 for which the delivery condition has been established, to be stored in the storage unit 220. Therefore, it is possible to recognize that the ink cartridge 24 is delivered to the delivery destination of the printing device 11 for which the delivery condition has been established. In the present embodiment, the controller 210 that performs this process functions as the delivery instructor 216. When this process is ended, the controller 210 ends the delivery management process.

Effects of the printing system 10 are described below.

In the printing device 11, an amount of the ink used for the ink ejection at the time of the printing is counted for each ink cartridge 24. In the printing device 11, an amount of the ink used to suction the ink at the time of the maintenance is counted for each ink cartridge 24. A remaining amount of the ink that is obtained by subtracting the counted amounts of the ink used from an amount of the ink before the printing and the maintenance is stored in the memory element of each ink cartridge 24. Therefore, it is possible recognize, as information on the use of the ink, the amount of the ink used and the remaining amount of the ink. When the transmission condition is established, the information on the use of the ink is transmitted from the printing device 11 to the server device 200.

After receiving the information on the use of the ink, the server device 200 registers the information on the use of the ink as used ink history information in the user information database DB. It is possible to recognize an amount of the ink used per predetermined time period and a remaining amount of the ink by referencing the used ink history information of the user information database DB.

When the amount of the ink used per predetermined time period is equal to or smaller than the standard amount, the server device 200 selects either the maintenance to be performed on the printing unit 20 or the predetermined notification regarding the use of the ink based on the remaining amount of the ink. In particular, when the remaining amount of the ink is equal to or larger than the amount required to perform the maintenance on the printing unit 20, the maintenance to be performed on the printing unit 20 is selected. On the other hand, when the remaining amount of the ink is smaller than the amount required to perform the maintenance on the printing unit 20, the predetermined notification regarding the use of the ink is selected. The information indicating the selection result selected by the server device 200 is transmitted from the server device 200 to the printing device 11.

Upon receiving the information indicating the selection result selected by the server device 200, the printing device 11 performs the maintenance on the printing unit 20 or performs the predetermined notification regarding the use of the ink based on the information indicating the selection result.

As described above in detail, according to the present embodiment, the following effects can be obtained.

(1) When the amount of the ink used for the predetermined time period is equal to or smaller than the standard amount, it is possible to perform either the maintenance or the predetermined notification regarding the replacement of an ink cartridge 24. Therefore, even when the frequency of use of the ink is low, it is possible to suppress deterioration of the printing quality due to adherence of the ink previously used to the printing unit 20 and coagulation of the ink or the like.

(2) When the amount of the ink used for the predetermined time period is equal to or smaller than the standard amount, it is possible to select either the maintenance to be performed or the predetermined notification based on a remaining amount of the ink. Therefore, it is possible to perform a process based on the remaining amount of the ink.

(3) When the amount of the ink used for the predetermined time period is equal to or smaller than the standard amount and the remaining amount of the ink is equal to or larger than the amount required to perform the maintenance, it is possible to perform the maintenance. Therefore, it is possible to perform the maintenance using a sufficient amount of the ink even without user-s intention and suppress deterioration of the printing quality.

(4) The maintenance includes the first maintenance and the second maintenance in which the ink in an amount larger than the amount of the ink to be used for the first maintenance is used, and the plurality of types of maintenance in which different amounts of the ink are used can be performed. When the amount of the ink used for the predetermined time period is equal to or smaller than the standard amount and the remaining amount of the ink is smaller than the amount required to perform the second maintenance and is equal to or larger than the amount of ink required to perform the first maintenance, the first maintenance can be performed. Therefore, it is possible to perform the maintenance of the type based on the remaining amount of the ink and suppress deterioration of the printing quality.

(5) When the amount of the ink used for the predetermined time period is equal to or smaller than the standard amount, it is possible to perform the maintenance or the predetermined notification based on not only the remaining amount of the ink but also the amount of the ink used for the predetermined time period. Therefore, even when the amount of the ink used for the predetermined time period is equal to or smaller than the standard amount, it is possible to perform a process based on the amount of the ink used.

(6) The server device 200 that is communicably connected to the plurality of printing devices 11 can centrally manage information on amounts of the ink used.

(7) It is possible to predict, based on the continuous unused time period for which the ink is not used in the predetermined time period, an amount of the ink to be used for the maintenance to be performed next. Therefore, before the maintenance is performed next, it is possible to predict an amount of the ink to be used for the maintenance to be performed next.

(8) When the remaining amount of the ink is smaller than the predicted amount of the ink to be used, it is possible to instruct to deliver ink. Therefore, even when the user does not request to deliver the ink, it is possible to deliver the ink, perform the maintenance next using a sufficient amount of the ink, and suppress deterioration of the printing quality.

(9) A time period in which the printing quality may deteriorate due to a low frequency of use of the ink is a time period of 30 days as a threshold. Therefore, a time period of 30 days or longer is used as the predetermined time period. Even when the frequency of use of the ink is low, it is possible to suppress deterioration of the printing quality.

Second Embodiment

A second embodiment is described below. Although the server device 200 includes the selector 212 in the first embodiment, each of the printing devices 11 may include a selector in the second embodiment. Configurations that are the same as or similar to those described in the first embodiment will not be described in the second embodiment.

Figure 11:
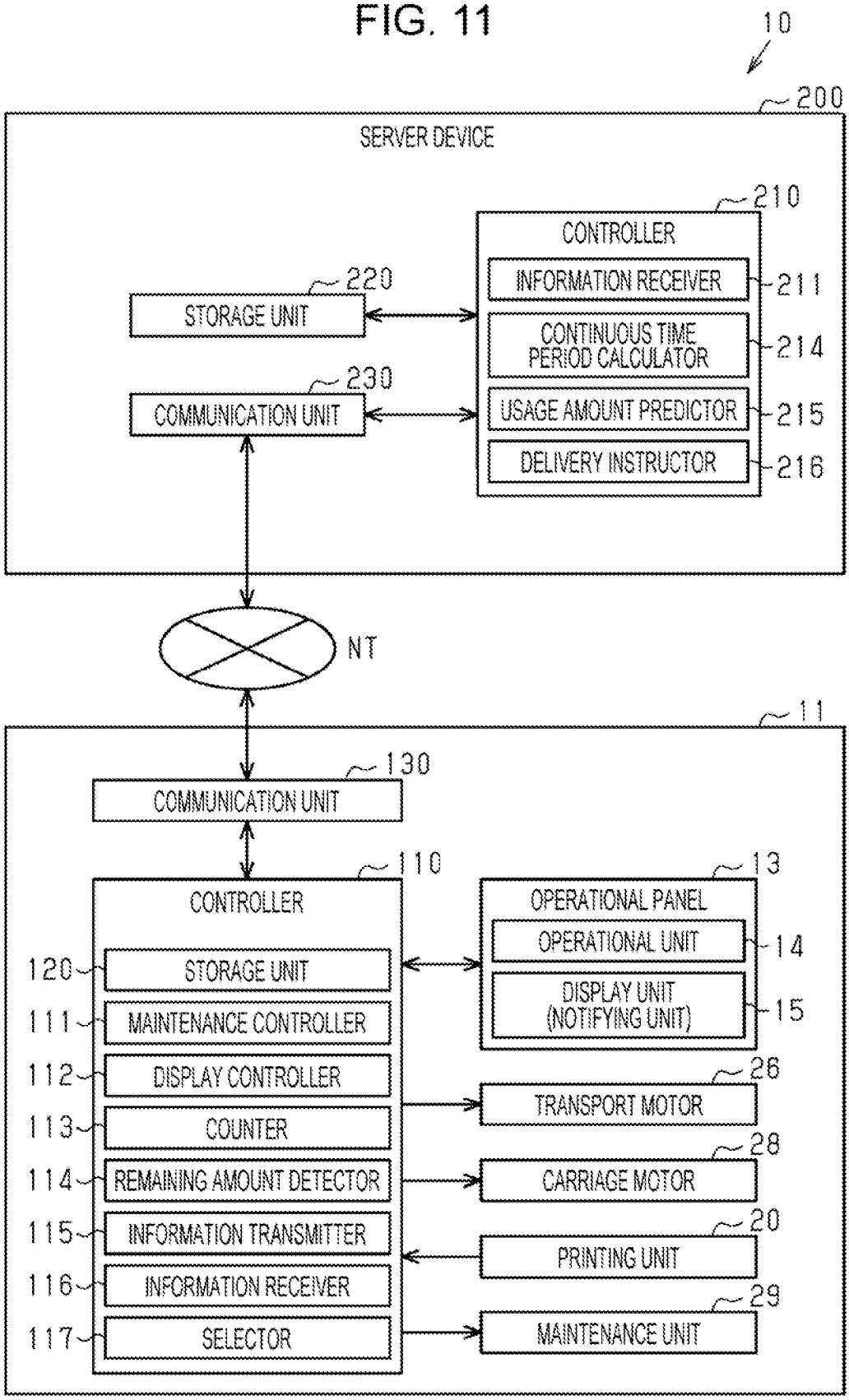
FIG. 11 is a block diagram illustrating an electric configuration of a printing system according to a second embodiment.

As illustrated in FIG. 11, in the printing device 11, the controller 110 also functions as a selector 117. The selector 117 according to the second embodiment has a function that is the same as or similar to the selector 212 according to the first embodiment. The selector 117 according to the second embodiment performs selection based on information generated by the printing device 11 and relating to the ink in a similar manner to the selector 212 according to the first embodiment. In this case, in the storage unit 120 according to the second embodiment, information corresponding to the user information database DB according to the first embodiment is stored. In the second embodiment, the server device 200 does not include the selector 212 and the information transmitter 213, but may include either one or both of the selector 212 and the information transmitter 213.

A process of controlling the ink amount related information by the printing device 11 is described with reference to FIG. 12. The process of controlling the ink amount related information is performed by the controller 110 of the printing device 11 at predetermined time intervals.

Figure 12:
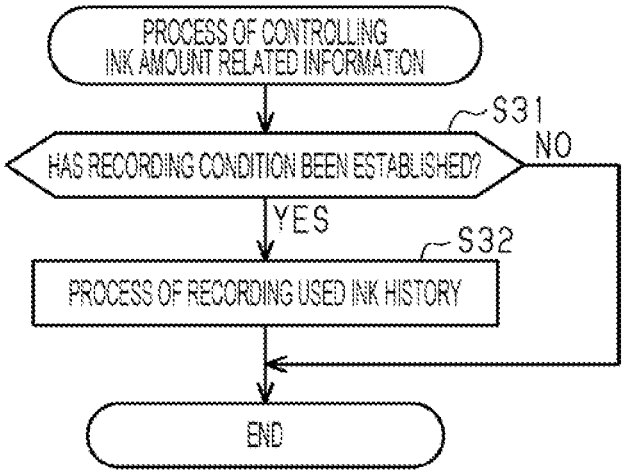
FIG. 12 is a flowchart illustrating a process of controlling the ink amount related information by the controller of the printing device.

As illustrated in FIG. 12, in step S31, the controller 110 determines whether a recording condition has been established. In the present embodiment, the recording condition is established at the time of power on of the printing device 11, the time of power off of the printing device 11, the end time of the printing, the end time of the maintenance, and the time of the replacement of an ink cartridge 24, like the transmission condition described in the first embodiment. When the controller 110 determines that the recording condition has not been established, the controller 110 does not perform step S32 and ends the process of controlling the ink amount related information. On the other hand, when the controller 110 determines that the recording condition has been established, the controller 110 causes the process to proceed to step S32.

In step S32, the controller 110 causes information on an amount of the ink used to be stored in the storage unit 120. In the present embodiment, the information on the amount of the ink used includes the time information, the used ink amount information, and the remaining ink amount information. When this process is ended, the controller 110 ends the ink amount related information control process.

Next, a process of monitoring an amount of ink by the printing device 11 is described with reference to FIG. 13. The process of monitoring an amount of ink is performed by the controller 110 of the printing device 11 at predetermined time intervals.

Figure 13:
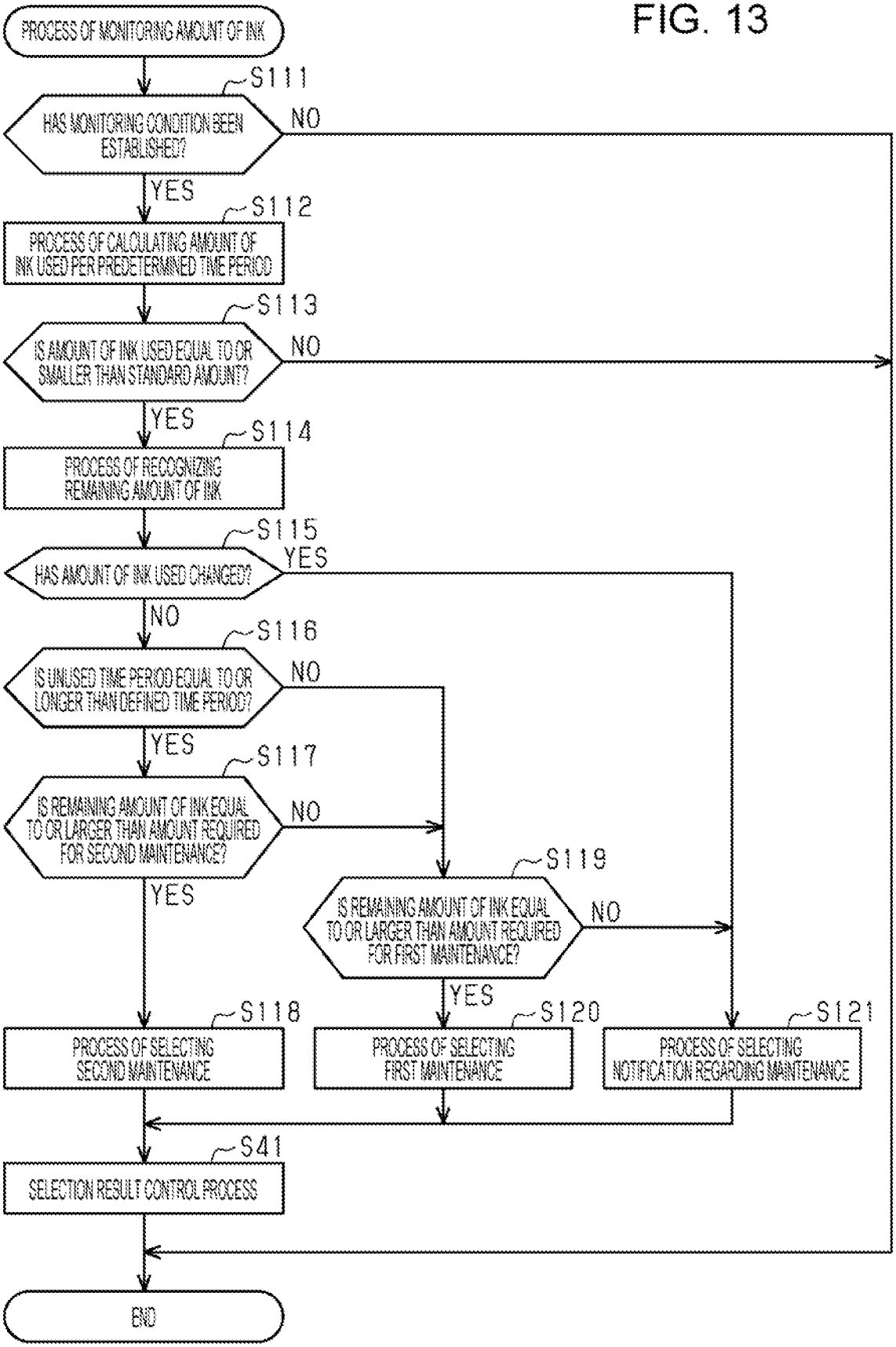
FIG. 13 is a flowchart illustrating a process of monitoring an amount of ink by the controller of the printing device.

As illustrated in FIG. 13, in the second embodiment, the controller 110 performs steps S111 to S121 that are the same as or similar to those described in the first embodiment. In step S41, the controller 110 performs the selection result control process illustrated in FIG. 7, instead of step S122 illustrated in FIG. 9 in the first embodiment. Therefore, the controller 110 of the printing device 11 functions as the selector 117 in the second embodiment in the same manner as the controller 210 that functions as the selector 212 in the server device 200 in the first embodiment.

Third Embodiment

A third embodiment is described below. In the first and second embodiments, the ink cartridges storing the ink are detachably attached. Instead of this, in the third embodiment, ink stored in an ink bottle may be injected in a storage body. The same configurations as those described in the first and second embodiments will not be described.

Figure 14:
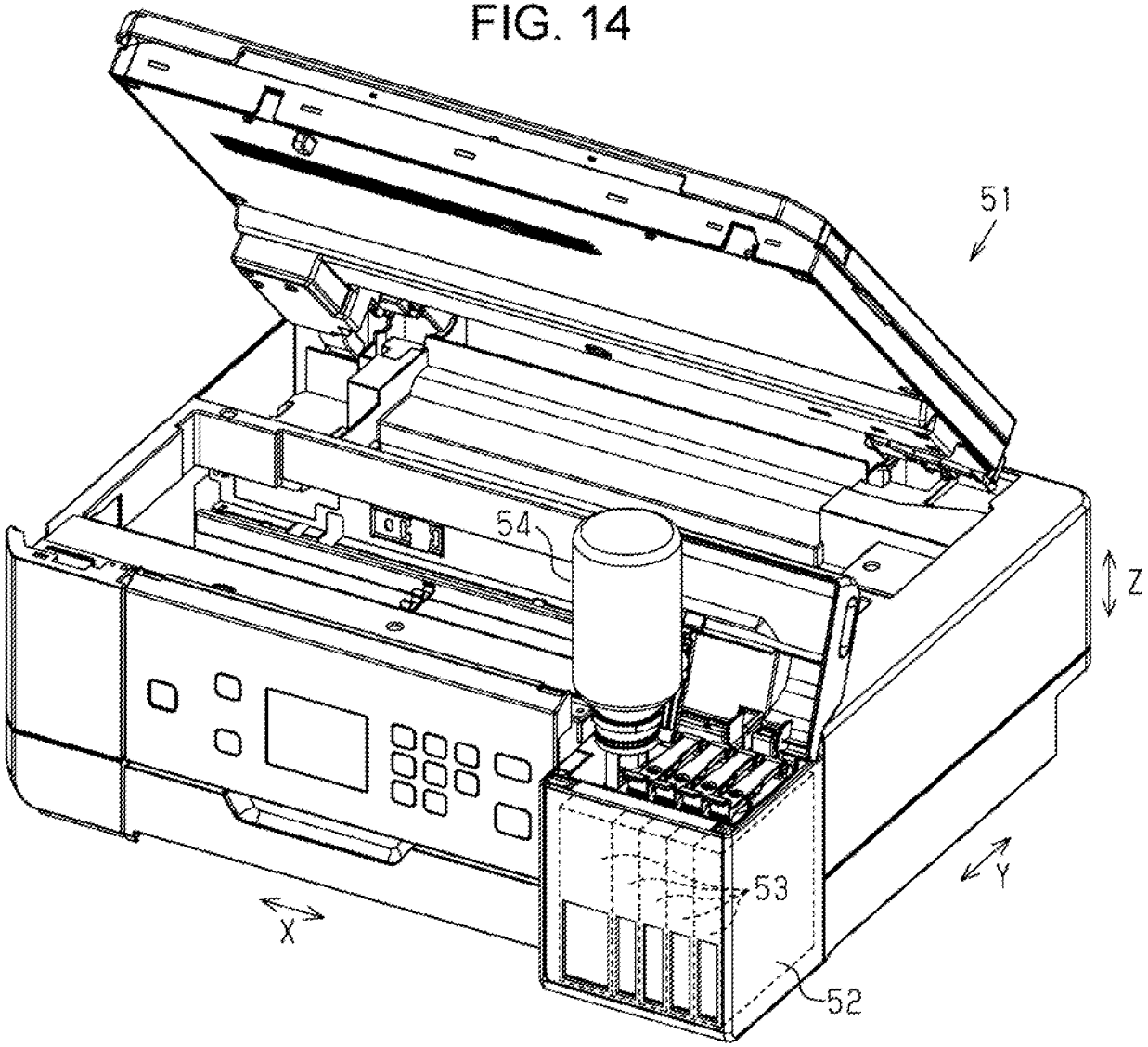
FIG. 14 is a perspective view of a printing device according to a third embodiment.

As illustrated in FIG. 14, a printing device 51 includes a storage body unit 52. The storage body unit 52 includes five storage bodies 53, but is not limited thereto. For example, the storage unit 52 may include one or more storage bodies. The storage bodies 53 store different types of ink. In the present embodiment, the ink may be of different ink color types such as cyan, magenta, yellow, and black or may be of different colorant types such as pigments or dyes included in the ink, but are not limited thereto. The storage bodies 53 are configured to be refilled with the ink from an ink bottle 54.

In the third embodiment, in this configuration, the replacement of an ink cartridge 24 in the first and second embodiments can be interpreted as refilling of a storage body 53 with the ink. In addition, the display unit 15 as an example of a notifying unit is configured to perform predetermined notification regarding the refilling of the storage bodies 53 with the ink.

The foregoing embodiments can be modified to the following modifications. Combinations of the foregoing embodiments and the following modifications may be used as modifications. Combinations of the following modifications may be used as modifications.

In the foregoing embodiments, for example, an amount of the ink to be used for the maintenance may be predicted based on a continuous time period for which an amount of the ink used for the predetermined time period is equal to or smaller than the standard amount. That is, the continuous time period calculator 214 may calculate the continuous time period for which the amount of the ink used for the predetermined time period is equal to or smaller than the standard amount. The usage amount predictor 215 may predict an amount of the ink to be used for the maintenance to be performed next, based on the continuous time period for which the amount of the ink used for the predetermined time period is equal to or smaller than the standard amount. Therefore, it is possible to predict the amount of ink to be used for the maintenance to be performed next, based on the continuous time period for which the amount of the ink used for the predetermined time period is equal to or smaller than the standard amount. Therefore, before the maintenance is performed next, it is possible to predict the amount of the ink to be used for the maintenance to be performed next.

In the foregoing embodiments, for example, an amount of the ink used may be counted based on the number of times that the carriage 21 of the printing unit 20 moves in the width direction X in the printing.

In the foregoing embodiments, the normal cleaning corresponds to the first maintenance and the powerful cleaning corresponds to the second maintenance, but the normal cleaning and the powerful cleaning are not limited thereto. For example, cleaning that is of a different type from the normal cleaning and the powerful cleaning and in which the ink in an amount different from the amounts of the ink to be used for the normal cleaning and the powerful cleaning is used may correspond to the first maintenance or the second maintenance. In addition, either one or both of the first maintenance and the second maintenance may not be limited to the cleaning. For example, flushing in which the liquid ejecting head 22 performs idle ejection to eject the ink may be used as either one or both of the first maintenance and the second maintenance. That is, the plurality of types of maintenance in which different amounts of the ink are used may be used as the first maintenance and the second maintenance.

In the foregoing embodiments, a time period from the time earlier than the current time by the predetermined time period to the current time is used as the predetermined time period, but is not limited thereto. For example, as the predetermined time period, a predetermined time period of a month or the like may be used, regardless of the current time. In this case, the control may be performed such that the monitoring condition is established at the start time of the predetermined time period.

In the foregoing embodiments, for example, in the case where the maintenance is determined to be performed, the maintenance may be performed at the time of power on of the printing device 11, the time of power off of the printing device 11, and a certain time in a time zone in which the printing device 11 is not used.

In the foregoing embodiments, for example, the various functions may be used for the printing device 11 in which the subscription information is invalid.

In the foregoing embodiments, ink may be arbitrarily selected as long as the ink can adhere to the medium M and can be printed on the medium M. The ink includes ink obtained by dissolving, dispersing, or mixing particles of a functional material made of a solid of a pigment or of metal particles in a solvent, and includes various compositions such as water-based ink, oil-based ink, gel ink, and hot melt ink.

In the foregoing embodiments, the print material is not limited to the liquid and may be, for example, toner or the like.

In the foregoing embodiments, the medium M may be, for example, a paper sheet, synthetic resin, metal, cloth, ceramic, rubber, or a complex thereof.

In the foregoing embodiments, it is sufficient if the printing device 11 performs printing by ejecting a liquid onto the medium M. The printing device 11 may be, for example, a serial printer, a lateral printer, a line printer, a page printer, an offset printing device, a textile printing device, or the like. In addition, the printing device 11 may include the sheet feeding cassette and a rear sheet feeding section, and a configuration at a position where sheets are fed may be arbitrary. Furthermore, it is sufficient if the printing device 11 has at least a printing function of performing the printing on the medium M. For example, the printing device 11 may be a multifunctional machine having the printing function and other functions. Furthermore, the printing device 11 is not limited to the device that performs the printing on a two-dimensional medium. The printing device 11 may perform printing on not only a two-dimensional medium but also a medium having a three-dimensional curved surface.

Technical ideas understood from the foregoing embodiments and the foregoing modifications are described together with effects.

A printing system includes a printing device configured to use a print material to perform printing on a medium, and a server device configured to communicate with the printing device via a network. In the printing system that manages the print material that is used by the printing device, the printing device includes a printing unit configured to use the print material stored in a storage body to perform the printing on the medium, a remaining amount detector configured to detect a remaining amount of the print material stored in the storage body, a maintenance unit configured to perform maintenance on the printing unit, and a notifying unit configured to perform predetermined notification regarding either replacement of the storage body or refilling of the storage body with the print material. Either the printing device or the server device includes a selector configured to select either the maintenance to be performed on the printing unit by the maintenance unit or the predetermined notification by the notifying unit based on the remaining amount of the print material detected by the remaining amount detector when an amount of the print material used for a predetermined time period is equal to or smaller than a defined amount.

According to this configuration, when the amount of the print material used for the predetermined time period is equal to or smaller than the defined amount, it is possible to perform the maintenance on the printing unit or perform the predetermined notification regarding either the replacement of the storage body or the refilling of the storage body with the print material. Therefore, even when the frequency of use of the print material is low, it is possible to suppress deterioration of the printing quality due to the adherence of the print material previously used to the printing unit and coagulation of the print material, or the like.

In addition, when the amount of the print material used for the predetermined time period is equal to or smaller than the defined amount, it is possible to select, based on the remaining amount of the print material, either the maintenance to be performed on the printing unit or the predetermined notification regarding either the replacement of the storage body or the refilling of the storage body with the print material. Therefore, it is possible to perform a process based on the remaining amount of the print material.

In the printing system, the selector may be configured to select the maintenance to be performed on the printing unit when the amount of the print material used for the predetermined time period is equal to or smaller than the defined amount and the remaining amount of the print material detected by the remaining amount detector is equal to or larger than an amount required to perform the maintenance on the printing unit.

According to this configuration, when the amount of the print material used for the predetermined time period is equal to or smaller than the defined amount and the remaining amount of the print material detected by the remaining amount detector is equal to or larger than the amount required to perform the maintenance on the printing unit, the maintenance can be performed on the printing unit. Therefore, it is possible to use a sufficient amount of the print material to perform the maintenance on the printing unit even without user-s intention and suppress deterioration of the printing quality.

In the printing system, the maintenance of the printing unit may include first maintenance and second maintenance in which the print material in an amount larger than an amount of the print material to be used for the first maintenance is used. The selector may be configured to select the first maintenance to be performed when the amount of the print material used for the predetermined time period is equal to or smaller than the defined amount and the remaining amount of the print material detected by the remaining amount detector is equal to or larger than an amount required to perform the first maintenance and is smaller than an amount required to perform the second maintenance.

According to this configuration, the maintenance of the printing unit includes the first maintenance and the second maintenance in which the print material in an amount larger than the amount of the print material to be used for the first maintenance is used, and it is possible to perform the plurality of types of maintenance in which the amounts of the print material to be used are different. When the amount of the print material used for the predetermined time period is equal to or smaller than the defined amount and the remaining amount of the print material is smaller than the amount required to perform the second maintenance and is equal to or larger than the amount required to perform the first maintenance, it is possible to perform the first maintenance. Therefore, it is possible to perform maintenance of a type based on the remaining amount of the print material and suppress deterioration of the printing quality.

The maintenance is not limited to the two types of maintenance and may be three or more types of maintenance including third maintenance whose intensity is between the intensity of the first maintenance and the intensity of the second maintenance, and the like.

In the printing system, the selector may be configured to select either the maintenance to be performed on the printing unit by the maintenance unit or the predetermined notification by the notifying unit based on the amount of the print material used for the predetermined time period when the amount of the print material used for the predetermined time period is equal to or smaller than the defined amount based on information on the amount of the print material used.

According to this configuration, when the amount of the print material used for the predetermined time period is equal to or smaller than the defined amount, it is possible to perform the maintenance on the printing unit or perform the predetermined notification based on not only the remaining amount of the print material but also the amount of the print material used for the predetermined time period. Therefore, even when the amount of the print material used for the predetermined time period is equal to or smaller than the defined amount, it is possible to perform a process based on the amount of the print material used.

In the printing system, the server device may include a receiver that receives information on the amount of the print material used from the printing device, the selector, and a transmitter that transmits information on the selection result selected by the selector to the printing device. The printing device may include a controller that controls either the maintenance to be performed on the printing unit by the maintenance unit or the predetermined notification by the notifying unit based on information on the selection result transmitted from the transmitter.

According to this configuration, the server device that is communicably connected to a plurality of printing devices can centrally manage information on amounts of the print material used.

In the printing system, the server device may include a continuous time period calculator that calculates a continuous time period for which the amount of the print material used for the predetermined time period is equal to or smaller than the defined amount, a usage amount predictor that predicts, based on the continuous time period calculated by the continuous time period calculator, an amount of the print material to be used for the maintenance to be performed next by the maintenance unit, and a delivery instructor that instructs to deliver the print material. The delivery instructor may instruct to deliver the print material when the remaining amount of the print material detected by the remaining amount detector is smaller than the amount of the print material to be used that was predicted by the usage amount predictor.

According to this configuration, it is possible to predict the amount of the print material to be used for the maintenance to be performed next, based on the continuous time period for which the amount of the print material used for the predetermined time period is equal to or smaller than the defined amount. Therefore, before the maintenance is performed next, it is possible to predict the amount of the print material to be used for the maintenance to be performed next.

When the remaining amount of the print material is smaller than the predicted amount of the print material to be used, it is possible to instruct to deliver the print material. Therefore, it is possible to deliver the print material without a user-s request for the delivery of the print material, use a sufficient amount of the print material to perform the maintenance next, and suppress deterioration of the printing quality.

In the printing system, the predetermined time period may be a time period of 30 days or longer.

According to this configuration, a time period in which the printing quality may deteriorate due to a low frequency of use of the print material is a time period of at least 30 days as a threshold. In this case, the predetermined time period is 30 days or longer, and it is possible to suppress deterioration of the printing quality even when the frequency of use of the print material is low.

A printing device that uses a print material to perform printing on a medium includes a printing unit configured to use the print material stored in a storage body to perform the printing on the medium, a remaining amount detector configured to detect a remaining amount of the print material stored in the storage body, a maintenance unit configured to perform maintenance on the printing unit, a notifying unit configured to perform predetermined notification regarding either replacement of the storage body or refilling of the storage body with the print material, and a selector configured to select either the maintenance to be performed on the printing unit by the maintenance unit or the predetermined notification by the notifying unit based on the remaining amount of the print material detected by the remaining amount detector when an amount of the print material used for a predetermined time period is equal to or smaller than a defined amount based on information on the amount of the print material used.

According to this configuration, it is possible to obtain effects that are the same as those obtained by the printing system.

What is claimed is:

1. A printing system that manages a print material, comprising:

a printing device configured to use the print material to perform printing on a medium; and a server device configured to communicate with the printing device via a network, wherein the printing device includes a printing unit configured to use the print material stored in a storage body to perform the printing on the medium, a remaining amount detector configured to detect a remaining amount of the print material stored in the storage body, a maintenance unit configured to perform maintenance on the printing unit, and a notifying unit configured to perform predetermined notification regarding either replacement of the storage body or refilling of the storage body with the print material, and either the printing device or the server device includes a selector configured to select either the maintenance to be performed on the printing unit by the maintenance unit or the predetermined notification by the notifying unit based on the remaining amount of the print material detected by the remaining amount detector when an amount of the print material used for a predetermined time period is equal to or smaller than a defined amount.

2. The printing system according to claim 1, wherein the selector is configured to select the maintenance to be performed on the printing unit when the amount of the print material used for the predetermined time period is equal to or smaller than the defined amount and the remaining amount of the print material detected by the remaining amount detector is equal to or larger than an amount required to perform the maintenance on the printing unit.

3. The printing system according to claim 2, wherein the maintenance of the printing unit includes first maintenance and second maintenance in which the print material in an amount larger than an amount of the print material to be used for the first maintenance is used, and the selector is configured to select the first maintenance to be performed when the amount of the print material used for the predetermined time period is equal to or smaller than the defined amount and the remaining amount of the print material detected by the remaining amount detector is equal to or larger than an amount required to perform the first maintenance and is smaller than an amount required to perform the second maintenance.

4. The printing system according to claim 1, wherein the selector is configured to select either the maintenance to be performed on the printing unit by the maintenance unit or the predetermined notification by the notifying unit based on the amount of the print material used for the predetermined time period when the amount of the print material used for the predetermined time period is equal to or smaller than the defined amount based on information on the amount of the print material used.

5. The printing system according to claim 1, wherein the server device includes a receiver that receives information on the amount of the print material used from the printing device, the selector, and a transmitter that transmits information on the selection result selected by the selector to the printing device, and the printing device includes a controller that controls either the maintenance to be performed on the printing unit by the maintenance unit or the predetermined notification by the notifying unit based on the information transmitted from the transmitter and relating to the selection result.

6. The printing system according to claim 1, wherein the server device includes a continuous time period calculator that calculates a continuous time period for which the amount of the print material used for the predetermined time period is equal to or smaller than the defined amount, a usage amount predictor that predicts, based on the continuous time period calculated by the continuous time period calculator, an amount of the print material to be used for the maintenance to be performed next by the maintenance unit, and a delivery instructor that instructs to delivery the print material, and the delivery instructor instructs to deliver the print material when the remaining amount of the print material detected by the remaining amount detector is smaller than the amount of the print material to be used that was predicted by the usage amount predictor.

7. The printing system according to claim 1, wherein the predetermined time period is 30 days or longer.

8. A printing device that uses a print material to perform printing on a medium, comprising:

a printing unit configured to use the print material stored in a storage body to perform the printing on the medium;

a remaining amount detector configured to detect a remaining amount of the print material stored in the storage body;

a maintenance unit configured to perform maintenance on the printing unit;

a notifying unit configured to perform predetermined notification regarding either replacement of the storage body or refilling of the storage body with the print material; and a selector configured to select either the maintenance to be performed on the printing unit by the maintenance unit or the predetermined notification by the notifying unit based on the remaining amount of the print material detected by the remaining amount detector when an amount of the print material used for a predetermined time period is equal to or smaller than a defined amount.

* * * * *